US006976831B2

(12) United States Patent
Hunter

(10) Patent No.: US 6,976,831 B2
(45) Date of Patent: Dec. 20, 2005

(54) TRANSMISSIONLESS VARIABLE OUTPUT PUMPING UNIT

(75) Inventor: Timothy H. Hunter, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 404 days.

(21) Appl. No.: 10/603,482

(22) Filed: Jun. 25, 2003

(65) Prior Publication Data

US 2004/0265155 A1 Dec. 30, 2004

(51) Int. Cl.[7] ..... F04B 19/00; F04B 37/00
(52) U.S. Cl. ..... 417/486; 417/53; 92/69 R
(58) Field of Search ..... 417/486, 487, 417/488, 53; 92/69 R, 75, 76

(56) References Cited

U.S. PATENT DOCUMENTS 4,029,289 A * 6/1977 Miffre ..... 251/58
4,112,826 A * 9/1978 Cataldo ..... 92/13.1
4,989,469 A 2/1991 Eslinger
5,073,096 A 12/1991 King et al.
5,127,807 A 7/1992 Eslinger
5,299,921 A 4/1994 Richter
5,362,215 A 11/1994 King
5,382,057 A 1/1995 Richter
2003/0072658 A1 * 4/2003 Park et al. ..... 417/417

FOREIGN PATENT DOCUMENTS

GB 2 099 519 12/1982 ..... F04B 49/00

OTHER PUBLICATIONS

Displacement Pump Definitions, pp. 261 and 262; undated but admitted to be prior art.
BarDyne Inc., Stillwater, OK, "Hydraulic System Design for Servie Assurance," pp. 248-259 (1999).

* cited by examiner

*Primary Examiner*—William H. Rodriguez
(74) *Attorney, Agent, or Firm*—John W. Wustenberg; McAfee & Taft

(57) ABSTRACT

A transmissionless variable output pumping unit comprising a multiple crankshaft pump driven by a prime mover. The apparatus includes an adjustment mechanism for adjusting a phase angle between first and second crankshafts. Plungers in the pump are disposed in cylinders forming part of a pumping chamber. When the phase angle is at a minimum, the plungers operate together for maximum discharge from the pump. When the phase angle is at a maximum, the plungers operate substantially opposite one another for zero discharge. The phase angle may be infinitely adjusted between the minimum and maximum.

35 Claims, 5 Drawing Sheets

TRANSMISSIONLESS VARIABLE OUTPUT PUMPING UNIT

BACKGROUND

This invention relates to reciprocating pumping units, and more particularly, a pumping unit having variable output without using a transmission between the pump and the prime mover therefor.

Reciprocating pumping units are well known, and such units have been used extensively in oil field applications, such as for pumping water into and out of the wells. Reciprocating pumps are known as fixed or positive displacement pumps.

Prime mover power sources for these pumps are typically diesel engines, but other devices may be used. Multi-ratio automatic transmissions are typically used to drive the pumps to achieve a finite selection of flow rates or pumping rates. Minor flow rate "rangeability" is enabled within any given gear in the transmission by varying the engine speed, but this often requires the engine to operate at less than its maximum horsepower capability which is obviously inefficient. Further, such pumping unit configurations cannot begin pumping at full engine speed, because they are not capable of withstanding the sudden stress on engaging the transmission at full engine speed. Instead, the transmission is shifted into the selected gear while the engine is at low speed, and the pump is at rest. The gear range is selected based on the desired initial pump discharge rate. After engaging the transmission, the engine speed is increased, thus transferring power through the torque converter in the transmission. Only then can the engine speed be increased to the engine's maximum horsepower rating. Once pumping has thus commenced, the transmissions may be shifted "on-the-fly" to achieve various discharge flow rates in an attempt to keep the engine operating near its peak power speed.

Such pumping unit designs do not provide infinitely variable discharge rates at full horsepower, and there is a need for a pumping unit which does provide this feature. A further problem with the prior art pumping units is that, as power requirements increase, the reliability of existing transmissions has proven to decrease to an unacceptable level.

The present invention solves these problems by providing a variable displacement pumping machine consisting of a multiple-crankshaft pump driven by a rotational power source which is enabled to operate at a constant speed if desired and thus take full advantage of the full power of the power source at any given discharge flow rate.

SUMMARY

The transmissionless variable output pumping unit of the present invention comprises a multiple crankshaft pump and a rotational prime mover or power source to drive the pump. The pumping unit can operate at a constant speed so that it can take advantage of the full power output of the prime mover at any particular discharge flow rate selected for the pump. The prime mover may be operated at various speeds depending on the desire output horsepower.

Rotational power is transmitted from the prime mover or movers through a synchronizing mechanism, and individual drive trains are coupled to each pump crankshaft. The individual drive systems are configured to cause the pump crankshafts to rotate at the same speed either in the same or opposite directions. The drive systems are positively synchronized in at least one position along the drive train. One or more of the individual drive trains comprises at least one planetary speed reducer. At least one of these planetary speed reducers is mounted such that it allows the traditionally stationary portion of its gearing to be rotated via a positioning mechanism to impart a phase lead or lag in its associated drive train. The traditionally stationary portion of the gear is typically the outer ring gear, but the invention is not intended to be so limited. The phase difference is used to alter the rotational relationship of the crankshafts in such a fashion as to increase or decrease the effective displacement of the pump.

The invention may be described as a pumping apparatus comprising a first cylinder, a second cylinder, a first plunger reciprocably disposed in the first cylinder and adapted for pumping fluid from the first cylinder, a second plunger reciprocably disposed in the second cylinder and adapted for pumping fluid from the second cylinder, a first crankshaft connectable to a prime mover and connected to the first plunger, a second crankshaft connectable to the prime mover and connected to the second plunger, and an adjustment mechanism connected to at least one of the first and second crankshafts such that a phase angle between the first and second crankshafts may be adjusted.

The phase angle may be adjusted between minimum and maximum phase angles corresponding to minimum and maximum pumping rates for the first and second plungers. Preferably, the phase angle may be infinitely adjusted between the minimum and maximum phase angles. The minimum phase angle is zero, and the maximum phase angle may be 180 degrees.

In one embodiment of the invention, the first and second cylinders are coaxial and have substantially the same diameter. In another embodiment, the first and second cylinders are angularly disposed to one another, such as at 90 degrees.

The apparatus further comprises a drive train connecting the first and second crankshafts to the prime mover. In a preferred embodiment, this drive train comprises a first drive shaft driven by the prime mover, a second drive shaft driven by the prime mover, a first gear train connected between the first drive shaft and the first crankshaft, and a second gear train connected between the second drive shaft and the second crankshaft. The first gear train is a planetary gear train having a fixed first outer housing, the second gear train is a planetary gear train having a second outer housing, and the adjustment mechanism further comprises an angular adjustment for the second outer housing corresponding to the phase angle.

One embodiment of the adjustment mechanism comprises a lever extending from the first outer housing. In another, the second outer housing has an outer geared surface, and the adjustment mechanism comprises a spur gear engaged with the outer geared surface. In a different drive train, the second outer housing has an outer geared surface, and the adjustment mechanism comprises a worm gear engaged with the outer geared surface.

Numerous objects and advantages of the invention will become apparent when the following detailed description of the preferred embodiments is read in conjunction with the drawings illustrating such embodiments.

BRIEF DESCRIPTION OF THE DRAWINGS

FIG. 8 shows details of one of the gear trains including a planet carrier.

DESCRIPTION OF THE PREFERRED EMBODIMENTS

First Embodiment

Figure 1:
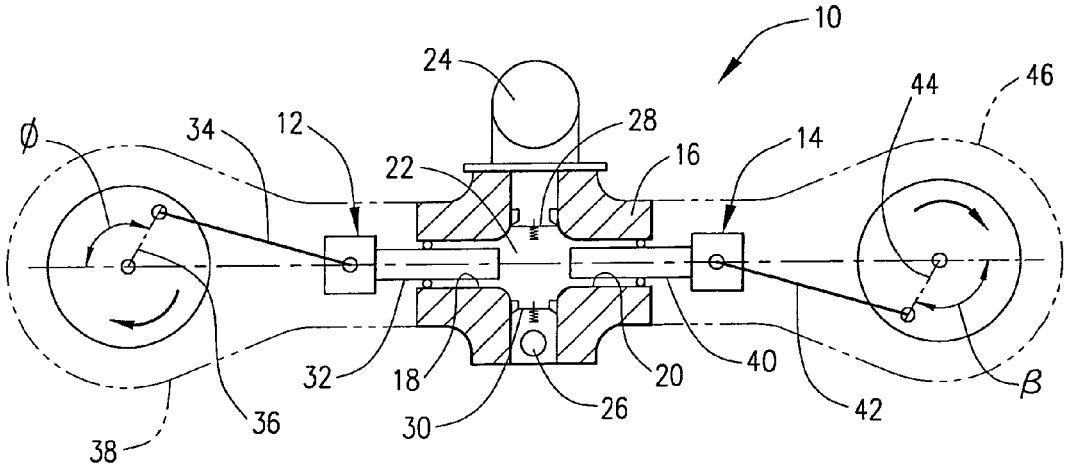
FIG. 1 shows a first embodiment of a transmissionless variable output pumping unit of the present invention having coaxial plungers in a maximum discharge configuration.
Figure 2:
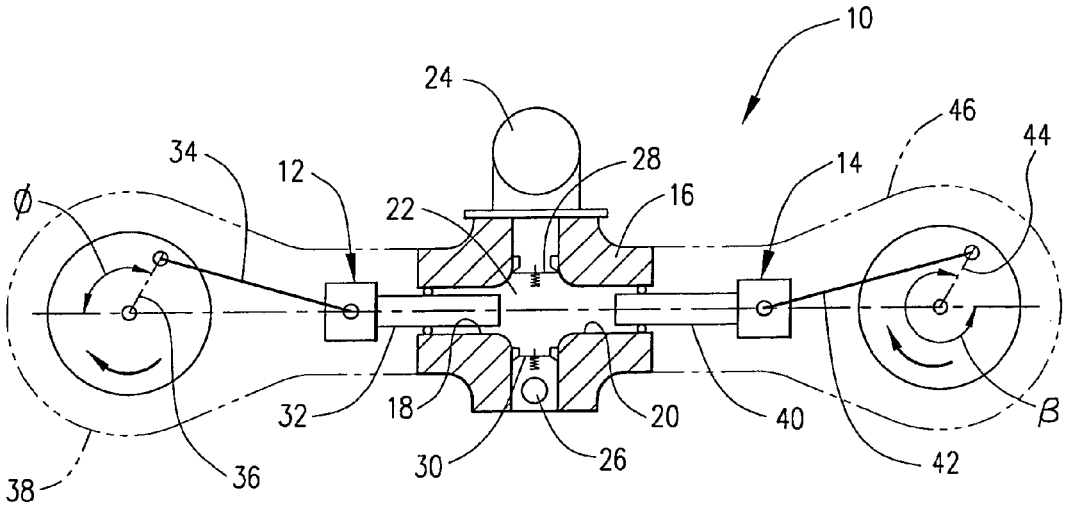
FIG. 2 shows the first embodiment in a zero discharge configuration.

Referring now to the drawings, and more particularly to FIGS. 1 and 2, a first embodiment of a transmissionless variable output pumping unit of the present invention is shown and generally designated by the numeral 10. First embodiment pumping unit 10 comprises a first pumping section 12 and a second pumping section 14. First and second pumping sections 12 and 14 are synchronized and driven by a gear train which will be subsequently described herein. First and second pumping sections 12 and 14 are positive displacement types. It should be understood that any of the pumping units described herein could have additional pumping sections, and the invention is not intended to be limited to those with two.

First and second pumping sections 12 and 14 operatively engage a pump housing 16 having a first cylinder bore 18 and a second cylinder bore 20 therein. It will be seen that first and second cylinder bores 18 and 20 are coaxial in first embodiment pumping unit 10 and in communication with one another. First and second cylinder bores 18 and 20 form portions of a pumping chamber 22 within pump housing 16. First and second cylinder bores 18 and 20 are also illustrated as having substantially the same diameter.

Pump housing 16 has an inlet or suction port 24 and an outlet or discharge port 26 therein. An inlet or suction valve 28 is disposed in pump housing 16 such that it allows fluid to flow from inlet port 24 into pumping chamber 22 while preventing reverse flow. An outlet or discharge valve 30 is also disposed in pump housing 16, and the discharge valve 30 allows fluid to flow from pumping chamber 22 into discharge port 26 while preventing reverse flow. Inlet valve 28 and discharge valve 30 are of a kind generally known in the art and allow fluid flow therethrough in only one direction. This flow of fluid through first embodiment pumping unit 10 will be further described herein.

First pumping section 12 comprises a first piston or plunger 32 reciprocably disposed in first cylinder bore 18. First plunger 32 is attached to a first connecting rod 34 which is in turn attached to a first crankshaft 36. First crankshaft 36 is rotatably disposed in a first crankcase 38 which is attached to pump housing 16 adjacent to first cylinder bore 18. The rotational mounting of first crankshaft 36 in first crankcase 38 is substantially known in the art.

Similarly, second pumping section 14 comprises a second piston or plunger 40 reciprocably disposed in second cylinder bore 20. Second plunger 40 is attached to a second connecting rod 42 which is in turn attached to a second crankshaft 44. Second crankshaft 44 is rotatably disposed in a second crankcase 46 which is attached to pump housing 16 adjacent to second cylinder bore 20. The rotational mounting of second crankshaft 44 in second crankcase 46 is substantially known in the art.

Each of crankshafts 36 and 44 can have multiple plungers mounted thereon, not just the single ones illustrated. Also, crankshafts 36 and 44 can be rotated in opposite directions if desired.

FIG. 1 illustrates first embodiment pumping unit 10 in a maximum pumping configuration wherein first and second pumping sections 12 and 14 operate in phase with one another. That is, in this maximum pumping configuration, first and second plungers 32 and 40 always move in opposite directions to one another. During a suction or intake cycle, first and second plungers 32 and 40 both move outwardly from pumping chamber 22, and during a pumping or discharge cycle, the first and second plungers 32 and 40 both move inwardly toward the pumping chamber 22. If first crankshaft 36 is rotated at an angle, Ø, from bottom dead center and second crankshaft 44 is rotated at an angle, β, from bottom dead center, then:

$$Ø=β$$

With first embodiment pumping unit 10 in this maximum pumping configuration, fluid enters pumping chamber 22 through inlet valve 28. When the pressure of fluid in pumping chamber 22 is less than the pressure in inlet port 24 less the pressure necessary to overcome the force of the springs in inlet valve 28, inlet valve 28 will open and fluid will flow inwardly therethrough. Fluid will not flow backward through discharge valve 30. When first and second plungers 32 and 40 reach the end of the suction stroke in which they are the maximum distance away from one another, they reverse direction and move toward each other to form the pumping cycle. When the pressure of fluid in pumping chamber 22 is greater than the pressure in discharge port 26 plus the pressure necessary to overcome the force of the springs in discharge valve 30, discharge valve 30 will open and fluid will flow outwardly therethrough. Fluid will not flow backward through inlet valve 28. It will be seen by those skilled in the art that this operation of first and second pumping sections 12 and 14 in phase with one another will produce the maximum flow of fluid through first embodiment pumping unit 10.

It should be noted that, while inlet valve 28 and discharge valve 30 are illustrated as spring-loaded plate valves, other types of known pump valves could be used. For example, reed valves could be incorporated. The invention is not intended to be limited to any particular valve construction.

Referring now to FIG. 2, a zero discharge configuration of first embodiment pumping unit 10 is illustrated. In this zero pumping configuration, first and second pumping sections 12 and 14 operate 180 degrees out of phase with one another. That is, in this zero pumping configuration, first and second plungers 32 and 40 always move in the same direction as one another. During a first cycle, first and second plungers 32 and 40 both move to the right with respect to pumping chamber 22, and during another pumping cycle, first and second plungers 32 and 40 both move to the left with respect to pumping chamber 22. If first crankshaft 36 is rotated at an angle, Ø, from bottom dead center and second crankshaft 44 is rotated at an angle, β, from bottom dead center, then:

$$Ø=β-180°$$

With first embodiment pumping unit 10 in this zero pumping configuration, substantially no fluid enters pumping chamber 22 through inlet valve 28 or is discharged therefrom through discharge valve 30. It will be seen by those skilled in the art that the total volume of pumping chamber 22 does not change. The fluid in it is simply moved back and forth so that nothing changes and no fluid is pumped in or out. This assumes that any heating of the fluid by this movement and any related change in density of the fluid is insignificant.

Second Embodiment

Figure 3:
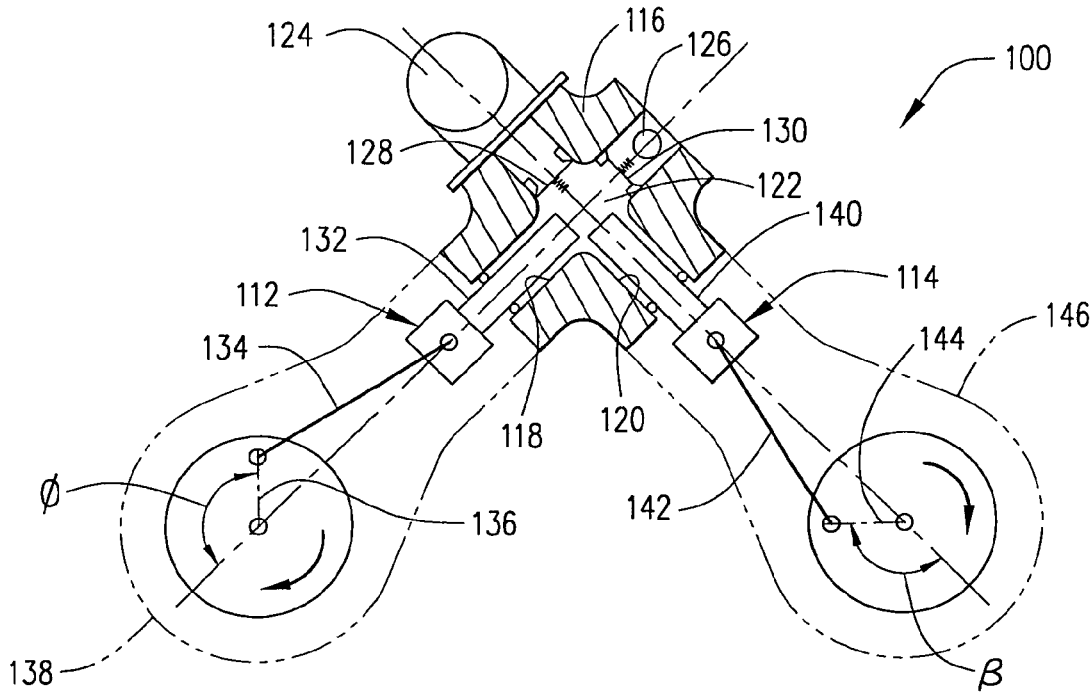
FIG. 3 illustrates a second embodiment of the invention having plungers that are angularly disposed to one another.

Referring now to FIG. 3, a second embodiment of the transmissionless variable output pumping unit of the present invention is shown and generally designated by the numeral 100. Second embodiment pumping unit 100 comprises a first pumping section 112 and a second pumping section 114. First and second pumping sections 112 and 114 are synchronized and driven by a gear train which will be subsequently described herein. First and second pumping sections 112 and 114 are positive displacement types.

First and second pumping sections 112 and 114 operatively engage a pump housing 116 having a first cylinder bore 118 and a second cylinder bore 120 therein. In this second embodiment pumping unit 100, first and second cylinder bores 118 and 120 are angularly disposed from one another and are in communication with one another. FIG. 3 illustrates this to be an angle of approximately 90 degrees, but the invention is not intended to be limited to any particular angle. First and second cylinder bores 118 and 120 form portions of a pumping chamber 122 within pump housing 116. First and second cylinder bores 118 and 120 are also illustrated as having substantially the same diameter.

Pump housing 116 has an inlet or suction port 124 and an outlet or discharge port 126 therein. An inlet or suction valve 128 is disposed in pump housing 116 such that it allows fluid to flow from inlet port 124 into pumping chamber 122 while preventing reverse flow. An outlet or discharge valve 130 is also disposed in pump housing 116, and discharge valve 130 allows fluid to flow from pumping chamber 122 into discharge port 126 while preventing reverse flow. Inlet valve 128 and discharge valve 130 are of a kind generally known in the art and allow fluid flow therethrough in only one direction. This flow of fluid through second embodiment pumping unit 100 will be further described herein.

First pumping section 112 comprises a first piston or plunger 132 reciprocably disposed in first cylinder bore 118. First plunger 132 is attached to a first connecting rod 134 which is in turn attached to a first crankshaft 136. First crankshaft 136 is rotatably disposed in a first crankcase 138 which is attached to pump housing 116 adjacent to first cylinder bore 118. The rotational mounting of first crankshaft 136 in first crankcase 138 is substantially known in the art.

Similarly, second pumping section 114 comprises a second piston or plunger 140 reciprocably disposed in second cylinder bore 120. Second plunger 140 is attached to a second connecting rod 142 which is in turn attached to a second crankshaft 144. Second crankshaft 144 is rotatably disposed in a second crankcase 146 which is attached to pump housing 116 adjacent to second cylinder bore 120. The rotational mounting of second crankshaft 144 in second crankcase 146 is substantially known in the art.

Each of crankshafts 136 and 144 can have multiple plungers mounted thereon, not just the single ones illustrated. Also, crankshafts 136 and 144 can be rotated in opposite directions if desired.

FIG. 3 illustrates second embodiment pumping unit 100 in a maximum pumping configuration wherein first and second pumping sections 112 and 114 operate in phase with one another. That is, in this maximum pumping configuration, first and second plungers 132 and 140 always move in the same direction with respect to pumping chamber 122. During a suction or intake cycle, first and second plungers 132 and 140 both move away from pumping chamber 122 toward a bottom dead center position, and during a pumping or discharge cycle, first and second plungers 132 and 140 both move toward pumping chamber 122 to a top dead center position. If first crankshaft 136 is rotated at an angle, Ø, from bottom dead center and second crankshaft 144 is rotated at an angle, β, from bottom dead center, then:

$$Ø=\beta$$

With second embodiment pumping unit 100 in this maximum pumping configuration, fluid enters pumping chamber 122 through inlet valve 128. When the pressure of fluid in pumping chamber 122 is less than the pressure in inlet port 124 less the pressure necessary to overcome the force of the springs in inlet valve 128, inlet valve 128 will open and fluid will flow inwardly therethrough. Fluid will not flow backward through discharge valve 130. When first and second plungers 132 and 140 reach the end of the suction stroke in which they are the maximum distance away from pumping chamber 122, they reverse direction and move toward pumping chamber 122 to form the pumping cycle. When the pressure of fluid in pumping chamber 122 is greater than the pressure in discharge port 126 plus the pressure necessary to overcome the force of the springs in discharge valve 130, discharge valve 130 will open and fluid will flow outwardly therethrough. Fluid will not flow backward through inlet valve 128. It will be seen by those skilled in the art that this operation of first and second pumping sections 112 and 114 in phase with one another will produce the maximum flow of fluid through second embodiment pumping unit 100.

A zero discharge configuration of second embodiment pumping unit 100 is when first and second pumping sections 112 and 114 operate 180 degrees out of phase with one another. That is, in this zero pumping configuration, first and second plungers 132 and 140 always move in opposite directions with respect to pumping chamber 122. During a first cycle, first plunger 132 moves toward pumping chamber 122 while second plunger 140 moves away from pumping chamber 122. During a second pumping cycle, first plunger 132 moves away from pumping chamber 122, and second plunger 140 moves toward pumping chambers 122. If first crankshaft 136 is rotated at an angle, Ø, from bottom dead center and second crankshaft 144 is rotated at an angle, β, from bottom dead center, then:

$$Ø=\beta-180^\circ$$

With second embodiment pumping unit 100 in this zero pumping configuration, substantially no fluid enters pumping chamber 122 through inlet valve 128 or is discharged therefrom through discharge valve 130. It will be seen by those skilled in the art that the total volume of pumping chamber 122 does not change. The fluid in it is simply moved back and forth so that nothing changes and no fluid is pumped in or out. This assumes that any heating of the fluid by this movement and any related change in density of the fluid is insignificant.

Third Embodiment

Figure 4:
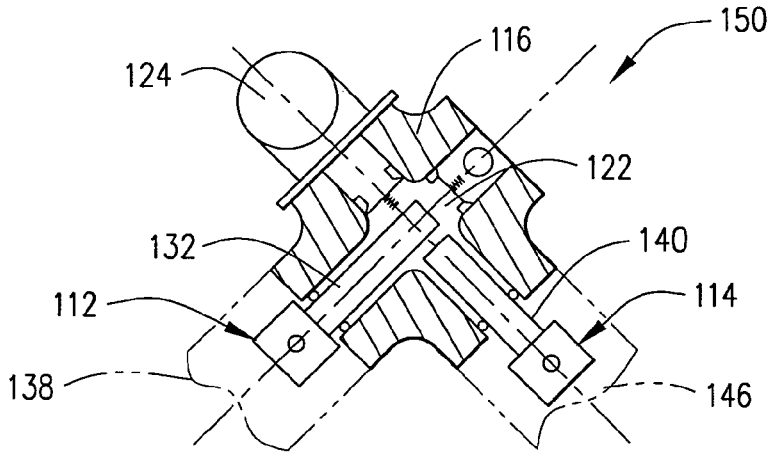
FIG. 4 shows a third embodiment of the invention having plungers that are angularly disposed and have a crossover position.

Referring now to FIG. 4, a third embodiment of the transmissionless variable output pumping unit of the present invention is shown and generally designated by the numeral 150. Third embodiment pumping unit 150 is similar to second embodiment pumping unit 100 in that the cylinders are angularly disposed from one another. The same reference numerals are used for similar components. In third embodiment pumping unit 150, however, plunger 132 can cross over plunger 140 as shown. This minimizes the unswept volume in pumping chamber 122.

Gear Train Detail

Figure 5:
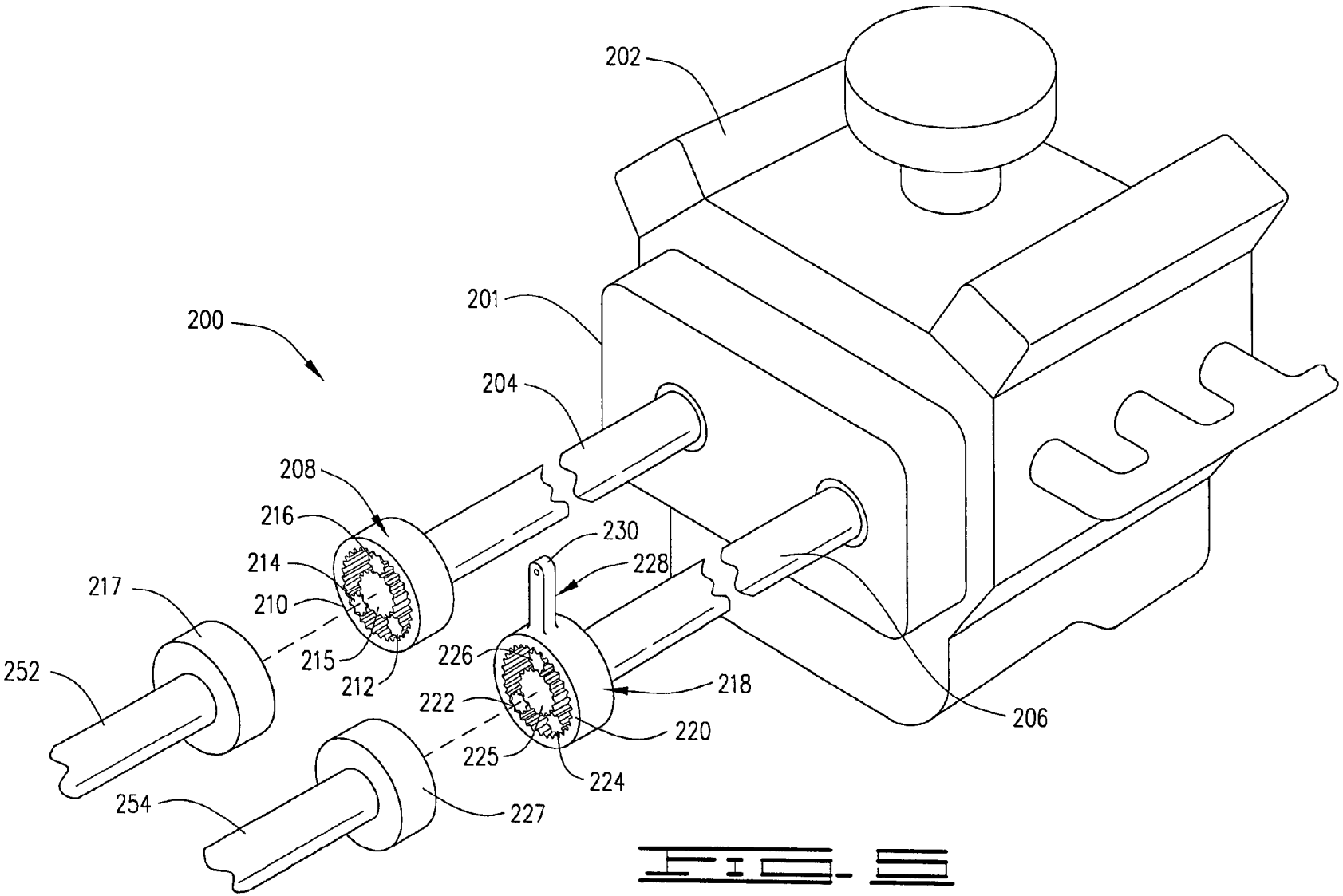
FIG. 5 shows details of gear trains used to adjust the phase angle between crankshafts in any of the embodiments of the invention, including a manual adjustment mechanism.
Figure 6:
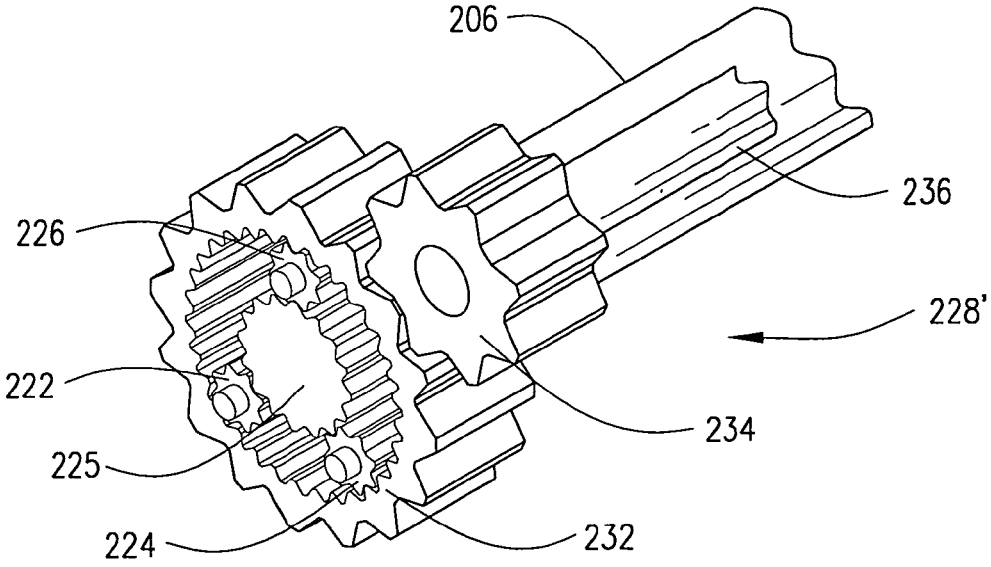
FIG. 6 is a detailed view of an adjustment mechanism having a spur gear drive.
Figure 7:
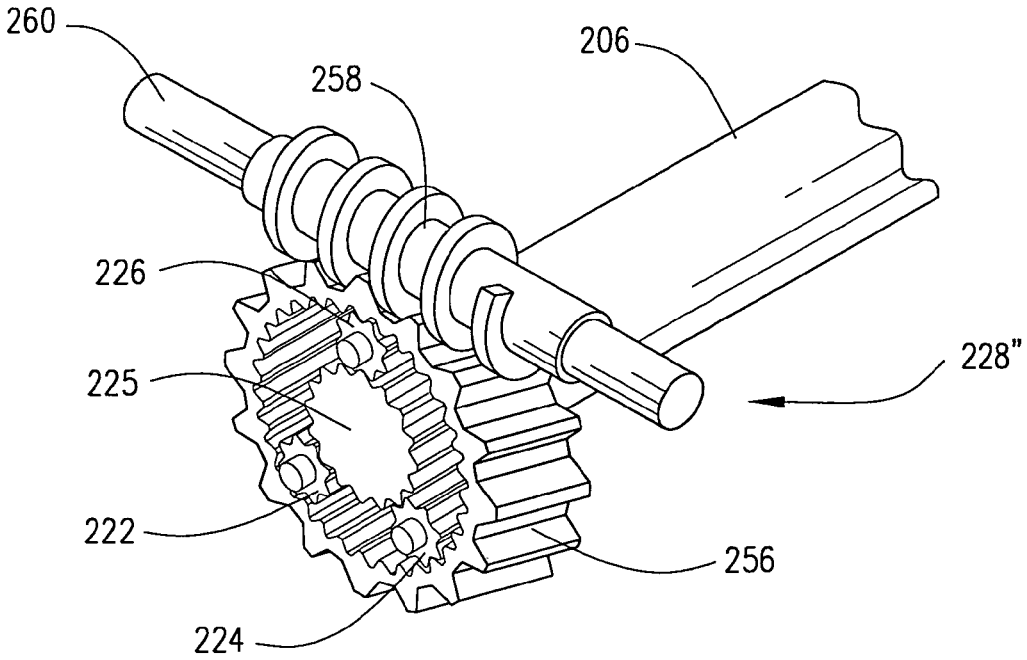
FIG. 7 is a detailed view of an adjustment mechanism having a worm gear drive.
Figure 3:
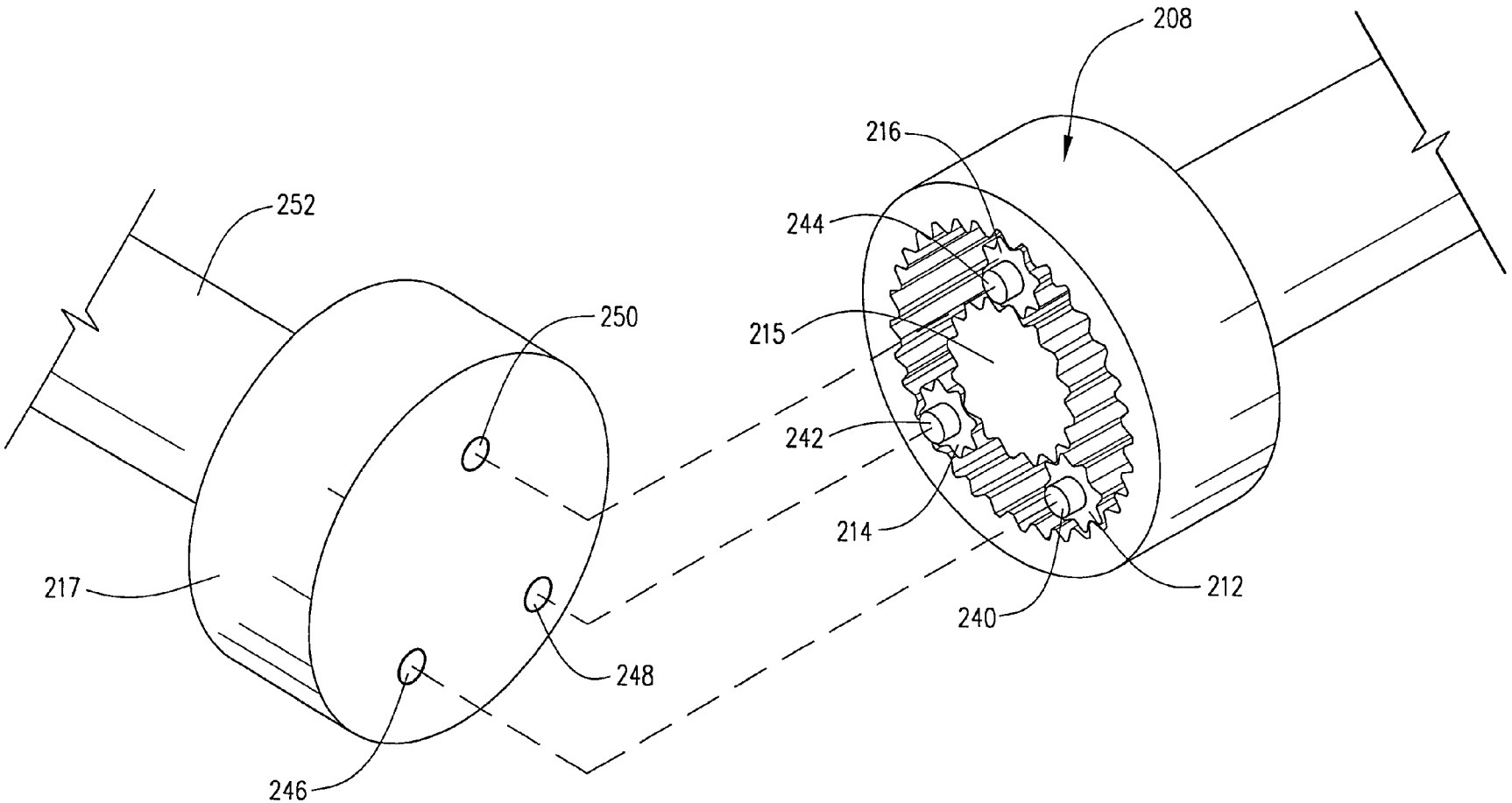

FIGS. 5–7 show different embodiments of a gear drive train to operate pumping unit 10, 100 or 150. Referring specifically to FIG. 5, one embodiment drive train 200 is shown. Drive train 200 may be used to drive any of the pumping unit embodiments previously described herein. As illustrated, drive train 200 is driven by a prime mover such as a diesel engine 202, although other prime movers would also be acceptable. Diesel engine 202 has a dual power take-off 201 connected thereto so that rotational power is provided to a first drive shaft 204 and a second drive shaft 206.

A first planetary gear reducer or gear train 208 is connected to first drive shaft 204. First planetary gear reducer 208 has a first outer housing 210 with a set of planetary gears 212, 214, and 216 disposed therein and around a first sun gear 215 on an end of first drive shaft 204. A first planet carrier 217 holds planetary gears, 212, 214, and 216 in relationship to one another.

Referring now to FIG. 8, details of first planet carrier 217 are shown. Planetary gears 212, 214, and 216 have a planetary gear shaft 240, 242, and 244 correspondingly extending therefrom. Planetary gear shafts 240, 242, and 244 fit in openings 246, 248, and 250, respectively, in first planet carrier 217. As first drive shaft 204 is driven by diesel engine 202, first sun gear 215 engages and drives planetary gears 212, 214, and 216 so that they orbit around first sun gear 215. It will be seen by those skilled in the art that this causes corresponding rotation of first planet carrier 217. First planet carrier 217 has a first output shaft 252 which is integral with or connected to first crankshaft 36 or 136. A speed reducer (not shown) of a kind known in the art may be used between first output shaft 252 and first crankshaft 36 or 136 if desired.

Similarly, a second planetary gear reducer or gear train 218 is connected to second drive shaft 206. Second planetary gear reducer 218 has a second outer housing 220 with a set of planetary gears 222, 224, and 226 disposed therein and around a second sun gear 225 on an end of second drive shaft 206. A second planet carrier 227 holds planetary gears 222, 224, and 226 in relationship to one another.

Second planet carrier 227 is substantially identical to first planet carrier 217 previously described and shown in FIG. 8. Second planet carrier 227 has a second output shaft 254 that is integral with or connected to second crankshaft 44 or 144. Again, a speed reducer (not shown) of a kind known in the art may be used between second output shaft 254 and second crankshaft 44 or 144 if desired.

First outer housing 210 is fixed and cannot rotate. Second outer housing 220 is not fixed. It may be rotated about second drive shaft 206. An adjustment mechanism 228 is used to rotate second outer housing 220 by an angle corresponding to the desired phase angle relationship between first and second pumping sections 12 and 14, such as the maximum and zero pumping configurations previously described or anything in between. In the embodiment of FIG. 5, adjustment mechanism 228 is shown as a lever 230. Lever 230 can be actuated by hand or by some other means, such as a pneumatic or hydraulic cylinder (not shown).

Referring now to FIG. 6, a different adjustment mechanism 228' is shown having a spur gear drive. In this embodiment, planetary gears 222, 224, and 226 and second planet carrier 227 are the same as previously described. Planetary gears 222, 224, and 226 are disposed around second sun gear 225 and within a second outer housing in the form of a first spur gear 232. A second spur gear 234 is engaged with the geared surface of first spur gear 232 and is mounted on a gear shaft 236. Gear shaft 236 can be driven by any means known in the art such as a rotary actuator, servo motor, etc.

Referring now to FIG. 7, an additional adjustment mechanism 228" is shown having a worm gear drive. In this embodiment, planetary gears 222, 224, and 226 and second planet carrier 227 are the same as previously described. Planetary gears 222, 224, and 226 are disposed around second sun gear 225 and within a second outer housing in the form of a first gear 256. A worm gear 258 is engaged with the geared surface of first gear 256. A worm gear shaft 260 extends from worm gear 258. Worm gear shaft 260 can be driven by any means known in the art such as a rotary actuator, servo motor, etc.

It will be seen, therefore, that the transmissionless variable output pumping unit of the present invention is well adapted to carry out the ends and advantages mentioned as well as those inherent therein. While several preferred embodiments have been shown for the purposes of this disclosure, numerous changes may be made by those skilled in the art. All such changes are encompassed with the scope and spirit of the appended claims.

What is claimed is:

1. A pumping apparatus comprising:

a first cylinder;

a second cylinder;

a first plunger reciprocably disposed in the first cylinder and adapted for pumping fluid from the first cylinder;

a second plunger reciprocably disposed in the second cylinder and adapted for pumping fluid from the second cylinder;

a first crankshaft connectable to a prime mover and connected to the first plunger;

a second crankshaft connectable to the prime mover and connected to the second plunger; and an adjustment mechanism connected to at least one of the first and second crankshafts such that a phase angle between the first and second crankshafts may be adjusted.

2. The apparatus of claim 1 wherein the phase angle may be adjusted between minimum and maximum phase angles corresponding respectively to maximum and minimum pumping rates for the first and second plungers.

3. The apparatus of claim 2 wherein the phase angle may be infinitely adjusted between the minimum and maximum phase angles.

4. The apparatus of claim 2 wherein the minimum phase angle is zero.

5. The apparatus of claim 1 wherein the first and second cylinders are coaxial.

6. The apparatus of claim 1 wherein the first and second cylinders have substantially the same diameter.

7. The apparatus of claim 1 wherein the first and second cylinders are angularly disposed to one another.

8. The apparatus of claim 7 wherein the first and second cylinders are disposed at a 90 degree angle from one another.

9. The apparatus of claim 1 further comprising a drive train connecting the first and second crankshafts to the prime mover.

10. The apparatus of claim 9 wherein the drive train comprises:

a first drive shaft driven by the prime mover;

a second drive shaft driven by the prime mover;

a first gear train connected between the first drive shaft and the first crankshaft; and a second gear train connected between the second drive shaft and the second crankshaft.

11. The apparatus of claim 10 wherein:

the first gear train comprises a first planetary gear train having a fixed first outer housing;

the second gear train comprises a second planetary gear train having a second outer housing; and an angular adjustment of the second outer housing corresponds to the phase angle.

12. The apparatus of claim 11 wherein the adjustment mechanism comprises a lever extending from the second outer housing.

13. The apparatus of claim 11 wherein:

the second outer housing has an outer geared surface; and the adjustment mechanism comprises a spur gear engaged with the outer geared surface.

14. The apparatus of claim 11 wherein:

the second outer housing has an outer geared surface; and the adjustment mechanism comprises a worm gear engaged with the outer geared surface.

15. A pumping apparatus comprising:

a first cylinder;

a second cylinder;

an inlet port in communication with the first and second cylinders;

an inlet valve disposed in the inlet port whereby fluid from the inlet port may enter the first and second cylinders;

a discharge port in communication with the first and second cylinders;

a discharge valve disposed in the discharge port whereby fluid may be discharged from the first and second cylinders to the discharge port;

a first plunger reciprocably disposed in the first cylinder and adapted for drawing fluid into the first cylinder through the inlet valve and pumping fluid from the first cylinder through the discharge valve;

a second plunger reciprocably disposed in the second cylinder and adapted for drawing fluid into the second cylinder through the inlet valve and pumping fluid from the second cylinder through the discharge valve;

a first crankshaft connectable to a prime mover and connected to the first plunger;

a second crankshaft connectable to the prime mover and connected to the second plunger; and an adjustment mechanism connected to at least one of the first and second crankshafts such that a phase angle between the first and second crankshafts may be adjusted.

16. The apparatus of claim 15 wherein the phase angle may be adjusted between minimum and maximum phase angles corresponding respectively to maximum and minimum pumping rates for the first and second plungers.

17. The apparatus of claim 16 wherein the phase angle may be infinitely adjusted between the minimum and maximum phase angles.

18. The apparatus of claim 16 wherein the minimum phase angle is zero.

19. The apparatus of claim 16 wherein the first and second plungers reach top dead center substantially simultaneously and reach bottom dead center substantially simultaneously when the phase angle is at the minimum phase angle.

20. The apparatus of claim 16 wherein the first plunger reaches top dead center when the second plunger reaches bottom dead center and the first plunger reaches bottom dead center when the second plunger reaches top dead center when the phase angle is the maximum phase angle.

21. The apparatus of claim 15 wherein the first and second cylinders are coaxial.

22. The apparatus of claim 21 wherein a maximum phase angle is 180 degrees.

23. The apparatus of claim 15 wherein the first and second cylinders have substantially the same diameter.

24. The apparatus of claim 15 wherein the first and second cylinders are angularly disposed to one another.

25. The apparatus of claim 24 wherein the first and second cylinders are disposed at a 90 degree angle from one another.

26. The apparatus of claim 15 further comprising a drive train connecting the first and second crankshafts to the prime mover.

27. The apparatus of claim 26 wherein the drive train comprises:

a first drive shaft driven by the prime mover;

a second drive shaft driven by the prime mover;

a first gear train connected between the first drive shaft and the first crankshaft; and a second gear train connected between the second drive shaft and the second crankshaft.

28. The apparatus of claim 27 wherein:

the first gear train comprises a first planetary gear train having a fixed first outer housing;

the second gear train comprises a second planetary gear train having a second outer housing; and an angular adjustment of the second outer housing corresponds to the phase angle.

29. The apparatus of claim 28 wherein the adjustment mechanism comprises a lever extending from the second outer housing.

30. The apparatus of claim 28 wherein:

the second outer housing has an outer geared surface; and the adjustment mechanism comprises a spur gear engaged with the outer geared surface.

31. The apparatus of claim 28 wherein:

the second outer housing has an outer geared surface; and the adjustment mechanism comprises a worm gear engaged with the outer geared surface.

32. A method of adjusting a flow rate of a pump, comprising the steps of:

providing a first crankshaft connected to a first plunger, wherein the first plunger is disposed in the pump;

providing a first drive shaft connectable to a primer mover;

providing a first planetary gear reducer having a first outer housing, wherein the first planetary gear reducer is connected between the first drive shaft and the first crankshaft;

providing a second crankshaft connected to a second plunger, wherein the second plunger is disposed in the pump;

providing a second drive shaft connectable to the primer mover;

providing a second planetary gear reducer having a second outer housing, wherein the second planetary gear reducer is connected between the second drive shaft and the second crankshaft; and adjusting a phase angle between the first and second crankshafts to adjust the flow rate of the pump.

33. The method of claim 32 wherein the phase angle may be adjusted between minimum and maximum phase angles corresponding respectively to maximum and minimum flow rates of the pump.

34. The method of claim 33 wherein the phase angle may be infinitely adjusted between the minimum and maximum phase angles.

35. The method of claim 32 wherein the step of adjusting the phase angle between the first and second crankshafts comprises the step of rotating the second outer housing about the second drive shaft.

* * * * *